US012404619B2

(12) United States Patent
Kwon et al.

(10) Patent No.: US 12,404,619 B2
(45) Date of Patent: Sep. 2, 2025

(54) WASHING MACHINE

(71) Applicant: SAMSUNG ELECTRONICS CO., LTD., Suwon-si (KR)

(72) Inventors: Baekgyu Kwon, Suwon-si (KR); Naeyoung Park, Suwon-si (KR); Minhyung Kim, Suwon-si (KR); Hyeonuk Na, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 314 days.

(21) Appl. No.: 17/703,568

(22) Filed: Mar. 24, 2022

(65) Prior Publication Data

US 2022/0251754 A1 Aug. 11, 2022

Related U.S. Application Data

(63) Continuation of application No. PCT/KR2022/001973, filed on Feb. 9, 2022.

(30) Foreign Application Priority Data

Feb. 9, 2021 (KR) ..... 10-2021-0018038

(51) Int. Cl.
*D06F 34/04* (2020.01)
*D06F 39/08* (2006.01)

(52) U.S. Cl.
CPC ..... *D06F 34/04* (2020.02); *D06F 39/085* (2013.01)

(58) Field of Classification Search
CPC ..... D06F 34/04; D06F 39/085; D06F 34/28; D06F 39/08; D06F 39/12; D06F 39/081
USPC ..... 68/208
See application file for complete search history.

(56) References Cited

U.S. PATENT DOCUMENTS

| | | | | |
|---|---|---|---|---|
| 9,453,299 | B2 | 9/2016 | Park et al. | |
| 2004/0148974 | A1* | 8/2004 | No | D06F 39/12 68/18 F |
| 2013/0185079 | A1* | 7/2013 | Park | H04L 12/2818 340/3.7 |
| 2018/0038040 | A1* | 2/2018 | Kim | D06F 39/14 |
| 2018/0135219 | A1* | 5/2018 | Frantz | D06F 39/14 |

FOREIGN PATENT DOCUMENTS

| | | | | |
|---|---|---|---|---|
| CN | 106149317 A | | 11/2016 | |
| CN | 107035728 A | * | 8/2017 | D06F 39/085 |
| CN | 110453455 A | | 11/2019 | |

(Continued)

OTHER PUBLICATIONS

Machine translation of KR-101100188-B1 (Year: 2011).*

(Continued)

*Primary Examiner* — Michael E Barr
*Assistant Examiner* — Thomas Bucci
(74) *Attorney, Agent, or Firm* — STAAS & HALSEY LLP

(57) ABSTRACT

A washing machine including a cabinet, a tub disposed inside the cabinet, a drain pump configured to discharge water from the tub, a service port to be connectable to a service device and configured to receive or transmit error information of the washing machine therethrough when the service device is connected to the service port, and a pump housing mounted on a part of the cabinet in which the drain pump is located, wherein the service port is disposed inside the pump housing.

13 Claims, 14 Drawing Sheets

(56) References Cited

FOREIGN PATENT DOCUMENTS

| | | | | | |
|---|---|---|---|---|---|
| EP | 2317000 | A1 | * | 5/2011 | ..... D06F 39/10 |
| EP | 2886704 | A1 | * | 6/2015 | ..... D06F 39/10 |
| JP | 2003-103091 | | | 4/2003 | |
| JP | 2006-68055 | A | | 3/2006 | |
| JP | 2018-108532 | A | | 7/2018 | |
| JP | 2018-134140 | A | | 8/2018 | |
| JP | 6742361 | | | 8/2020 | |
| KR | 2002-0012023 | A | | 2/2002 | |
| KR | 2002-0012036 | A | | 2/2002 | |
| KR | 2002-0012037 | A | | 2/2002 | |
| KR | 2002-0012038 | A | | 2/2002 | |
| KR | 2002-0022986 | A | | 3/2002 | |
| KR | 10-0479092 | B1 | | 3/2005 | |
| KR | 10-2008-0093344 | | | 10/2008 | |
| KR | 20080093344 | A | * | 10/2008 | |
| KR | 10-2011-0126437 | | | 11/2011 | |
| KR | 20110126437 | A | * | 11/2011 | |
| KR | 101100188 | B1 | * | 12/2011 | |
| KR | 10-1709478 | | | 2/2017 | |
| KR | 10-1709480 | B1 | | 2/2017 | |
| KR | 10-2019-0028036 | | | 3/2019 | |
| KR | 10-2020-0143338 | A | | 12/2020 | |

OTHER PUBLICATIONS

International Search Report dated May 30, 2022 in PCT Application No. PCT/KR2022/001973.
Office Action dated Feb. 9, 2024 issued in European Application No. EP 22 75 2976.

* cited by examiner

WASHING MACHINE

CROSS-REFERENCE TO RELATED APPLICATION

This application is a continuation application, under 35 U.S.C. § 111(a), of international application No. PCT/KR2022/001973 filed on Feb. 9, 2022, which claims priority to Korean Patent Application No. 10-2021-0018038, filed on Feb. 9, 2021, in the Korean Intellectual Property Office, the disclosure of which is incorporated herein by reference.

BACKGROUND

1. Field

The disclosure relates to a washing machine having a service port, and more specifically, to a washing machine having a drain pump and a service port.

2. Description of the Related Art

A washing machine is a household appliance that washes clothes, towels, bedding, and the like. Washing machines may be classified into drum type washing machines that rotate a drum and cause laundry to repeat rising and falling to wash the laundry and electronic type washing machines that wash laundry using a water flow generated by a pulsator when a drum rotates.

Regardless of the type of washing machine, operations performed by the washing machine may include a washing operation in which detergent water is supplied to a tub containing laundry and the laundry is washed while rotating a drum, a rinsing operation in which rinsing water is supplied to the tub and the drum is rotated to rinse the laundry, and a spin-drying operation in which water is discharged from the tub and the drum is rotated to remove moisture from the laundry.

The washing machine may include a controller configured for controlling the above-described operations, and a service port for checking update and/or error codes of the controller. Typically, the service port is located on a rear surface of the washing machine not to damage the appearance of the washing machine, for which it is difficult to access the service port.

SUMMARY

One aspect of the disclosure provides a washing machine with improved accessibility to a service port.

Another aspect of the disclosure provides a washing machine with improved accessibility to a service port without damaging the appearance thereof.

Another aspect of the disclosure provides a washing machine capable of preventing damage to a service port.

According to an aspect of the disclosure, there is provided a washing machine including: a cabinet; a tub disposed inside the cabinet; a drain pump configured to discharge water from the tub; a service port connectable to a service device and configured to receive or transmit error information of the washing machine therethrough when the service device is connected to the service port; and a pump housing mounted on a part of the cabinet in which the drain pump is located, wherein the service port is disposed inside the pump housing.

The washing machine may further include a pump cover detachably coupled to the pump housing to open or close the pump housing, wherein when the pump cover is coupled to the pump housing the pump cover closes the pump housing so that the service port is hidden inside the pump housing.

When the pump cover covers the pump housing, the pump cover may form a part of a front surface of the cabinet.

The washing machine may further include a port cover detachably coupled to the pump housing to cover a part of the pump housing, and the pump cover is detachably coupled to the pump housing to cover the port cover and the pump housing.

The drain pump may include a pump handle, and the pump housing may include a housing opening through which the pump handle is exposed when the pump cover is open, and the port cover may include a cover opening to correspond to the housing opening so that the pump handle is exposed in the pump housing through the housing opening and the cover opening.

The pump housing may covers a part of the drain pump while the pump handle is exposed in the pump housing through the housing opening of the pump housing.

The pump housing may include a port mounting portion on which the service port is mounted, and the port mounting portion may include a connection opening to allow a part of the service port to be exposed.

The washing machine may further include a port cover to open and close the connection opening, and the port cover is made of an elastic material.

The port mounting portion may protrude from an inner surface of the pump housing that is covered by the pump cover.

The service port may be hook-coupled to the port mounting portion.

The service port may be accessible when the pump cover is open.

One end of the service port which is connected to the service device, may be located in a space between the tub and the pump housing.

The pump housing may include a material different from a material forming the cabinet.

The pump cover may be rotatably coupled to the pump housing to open or close the pump housing so that the service port is hidden inside the pump housing when the pump cover closes the pump housing.

The washing machine may further include a controller electrically connected to the service port, and when the service device is connected to the service port, the controller is configured to update firmware of the washing machine or transmit error codes included in the error information to the service device.

A washing machine including: a cabinet; a tub provided inside the cabinet; a drain pump configured to discharge water from the tub and having a pump handle; a pump housing mounted on a part of the cabinet in which the drain pump is located and configured to cover a part of the drain pump except the pump handle; a pump cover detachably coupled to the pump housing to cover the pump housing; and a service port arranged to protrude from one surface that is covered by the pump cover, and a port cover provided to prevent water from infiltrating into the service port.

The port cover may include a material having an elasticity.

The pump cover, when coupled to the pump housing, may form a part of a front surface of the cabinet while covering the service port.

The pump housing may be provided to separate a space in which the tub is located from a space the service port is located.

The pump housing may include a housing opening formed to allow the pump handle to be exposed when the pump cover is open, and the port cover may include a cover opening formed to correspond to the housing opening.

The service port may be provided to be accessible when the pump cover is open.

The washing machine may further include a controller electrically connected to the service port, and the controller, when the service port is connected to the service device, may be configured to update firmware or check error codes based on information transmitted from the service device.

As is apparent from the above, according to an aspect of the disclosure the washing machine has a service port located on a pump housing that is located on a front surface of a cabinet, so that access to the service port can be facilitated.

According to an aspect of the disclosure, the washing machine is provided such that when the service port is not in use, the service port is covered by a pump cover, so that accessibility to the service port is improved without damaging, the appearance of the washing machine.

According to an aspect of the disclosure, the washing machine includes a port cover that covers the service port, so that damage to the service port can be prevented.

DETAILED DESCRIPTION

Figure 1:
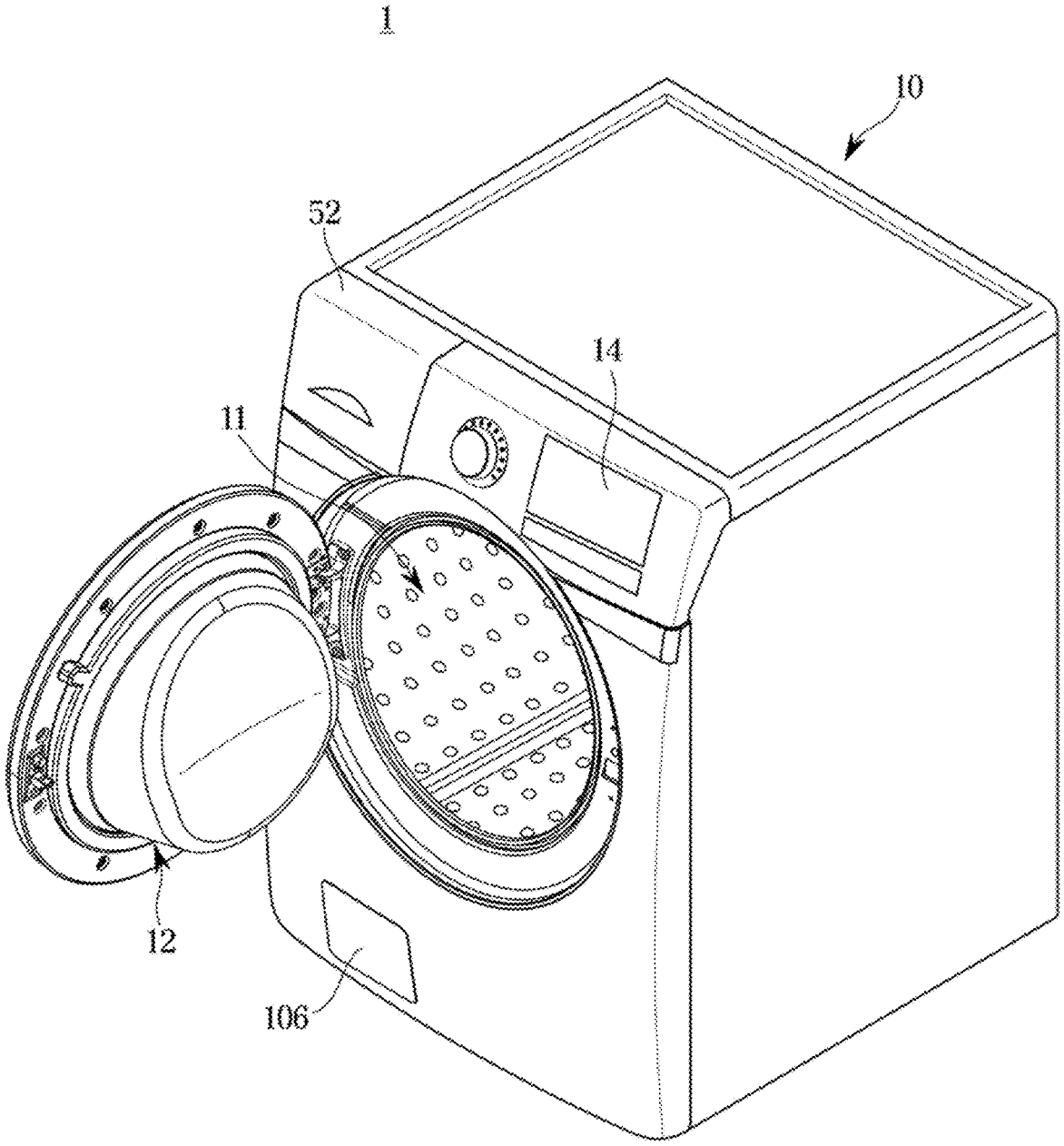
FIG. 1 is a view illustrating a washing machine according to an embodiment of the disclosure.

The embodiments set forth herein and illustrated in the configuration of the disclosure are only the most preferred embodiments and are not representative of the full technical spirit of the disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

Hereinafter, embodiments according to the disclosure will be described in detail with reference to the accompanying drawings.

Figure 2:
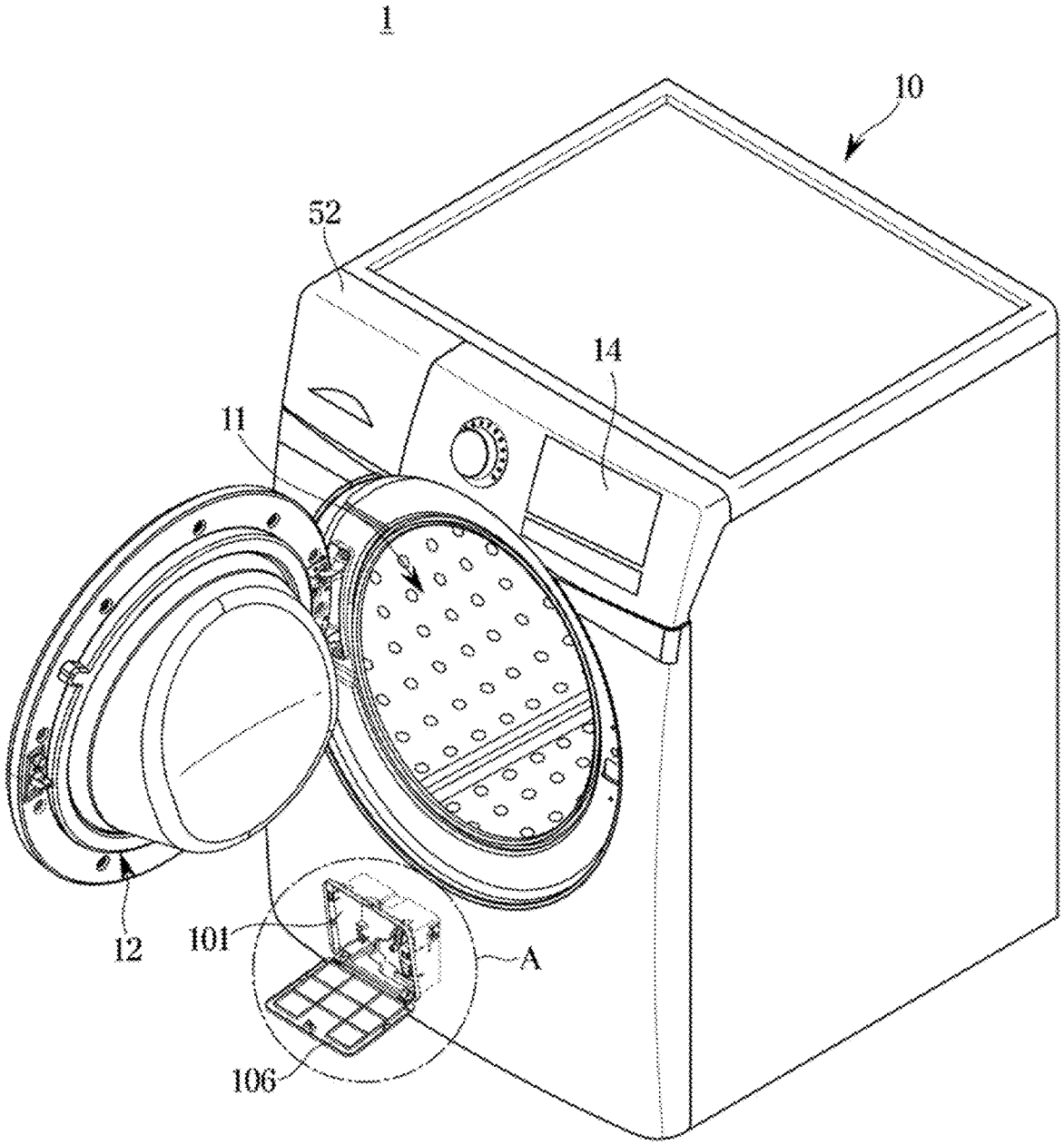
FIG. 2 is a view illustrating a state in which a drain pump cover of the washing machine shown in FIG. 1 is open.
Figure 3:
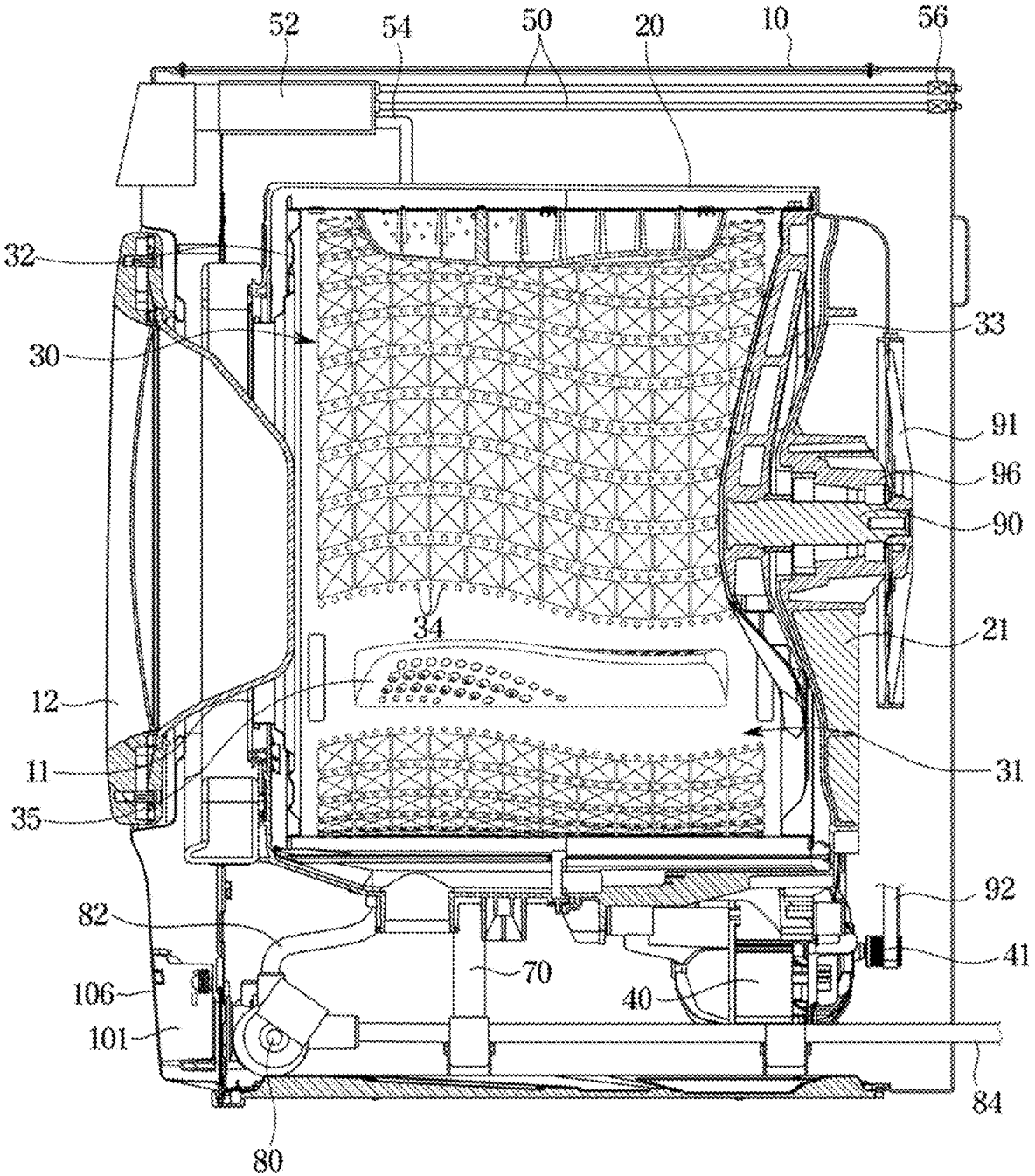
FIG. 3 is a view illustrating a side cross-section of the washing machine shown in FIG. 1.

FIG. 1 is a view illustrating a washing machine according to an embodiment of the disclosure. FIG. 2 is a view illustrating a state in which a drain pump cover of the washing machine shown in FIG. 1 is open. FIG. 3 is a view illustrating a side cross-section of the washing machine shown in FIG. 1.

Referring to FIGS. 1 to 3, a washing machine 1 includes a cabinet 10 forming the external appearance, a tub 20 disposed in the cabinet 10, a drum 30 rotatably disposed in the tub 20, and a driving motor 40 to drive the drum 30.

The cabinet 10 is provided at a front portion with an inlet 11 through which laundry may be inserted into the drum 30. The inlet 11 is opened and closed by a door 12 installed on the front portion of the cabinet 10.

A water supply pipe 50 to supply wash water to the tub 20 is installed at an upper portion of the tub 20. One side of the water supply pipe 50 is connected to a water supply valve 56, and the other side of the water supply pipe 50 is connected to a detergent box 52.

The detergent box 52 is connected to the tub 20 through a connection pipe 54. Water supplied through the water supply pipe 50 is supplied into the tub 20 together with a detergent via the detergent box 52.

The tub 20 is supported by a damper 70. The damper 70 connects an inner bottom surface of the cabinet 10 and an outer surface of the tub 20.

The drum 30 includes a cylindrical portion 31, a front panel 32 disposed in front of the cylindrical portion 31, and a rear panel 33 disposed behind the cylindrical portion 31. An opening for entry and exit of laundry is formed in the front panel 32, and a shaft 90 to transmit power of the driving motor 40 is connected to the rear panel 33.

A plurality of through holes 34 for distribution of wash water are formed around a circumference of the drum 30, and a plurality of lifters 35 are installed on an inner peripheral surface of the drum 30 so that rising and falling of laundry may occur while the drum 30 is rotating.

The drum 30 and the driving motor 40 are connected through the shaft 90, and according to the form of connection between the shaft 90 and the driving motor 40, driving types may be classified into a direct driving type in which the shaft 90 is directly connected to the driving motor 40 to rotate the drum 30 and an indirect driving type in which a pulley 91 is connected between the driving motor 40 and the shaft 90 to drive the drum 30.

The washing machine 1 according to one embodiment of the disclosure may be provided as the indirect driving type, but the disclosure is not limited thereto, and technical features of the disclosure may also be applied to the direct driving type.

One end of the shaft 90 is connected to the rear panel 33 of the drum 30, and the other end of the shaft 90 extends to an outer side of a rear side portion 21 of the tub 20. The other end of the shaft 90 may be provided to be inserted into the pulley 91 to obtain driving force from the driving motor 40. In addition, a motor pulley 41 is formed on a rotating shaft of the driving motor 40. A driving belt 92 may be provided between the motor pulley 41 and the shaft pulley 91 so that the shaft 90 may be driven by the driving belt 92.

The driving motor 40 may be disposed at one side of a lower side portion of the tub 20 so that the driving belt 92 may drive the shaft 90 while rotating clockwise or counter-clockwise in the upper-lower direction of the tub 20.

A bearing housing 96 is installed at the rear side portion 21 of the tub 20 so as to rotatably support the shaft 90. The bearing housing 96 may be formed of an aluminum alloy and may be inserted into the rear side portion 21 of the tub 20 during injection molding of the tub 20.

At a lower portion of the tub 20, a drain pump 80 configured to discharge water inside the tub 20 to the outside of the cabinet 10, a connecting hose 82 configured to connect the tub 20 and the drain pump 80 such that the water inside the tub 20 is introduced into the drain pump 80, and a drain hose 84 configured to guide the water pumped by the drain pump 80 to the outside of the cabinet 10 are provided.

Meanwhile, a display 14 for displaying the state of the washing machine 1 to the user may be provided on a front upper portion of the cabinet 10. The display 14 may include an inputter. A printed circuit board assembly (not shown) may be provided on the front upper portion of the cabinet 10.

Figure 4:
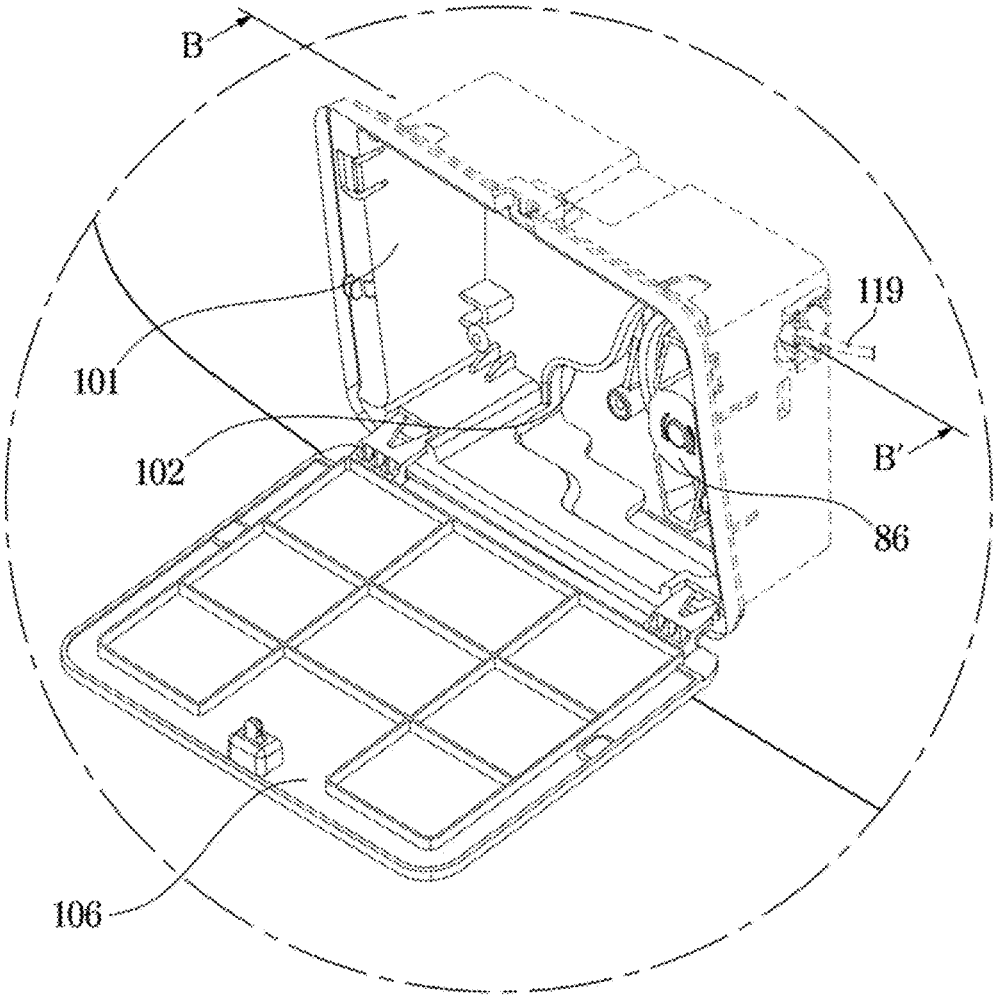
FIG. 4 is an enlarged view of a front surface of part A shown in FIG. 2.
Figure 5:
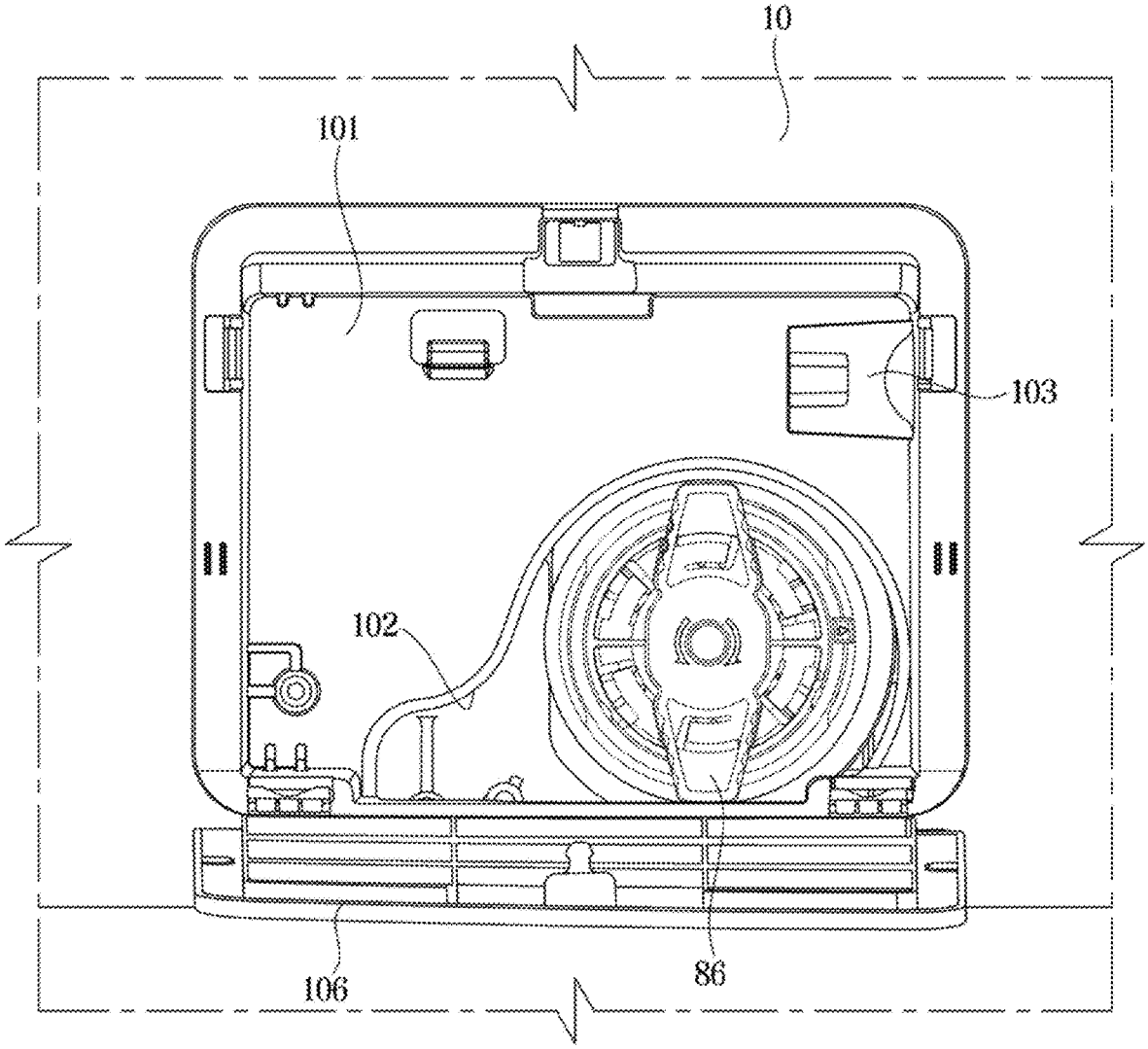
FIG. 5 is a front view illustrating a portion having a pump housing of the washing machine shown in FIG. 4.
Figure 6:
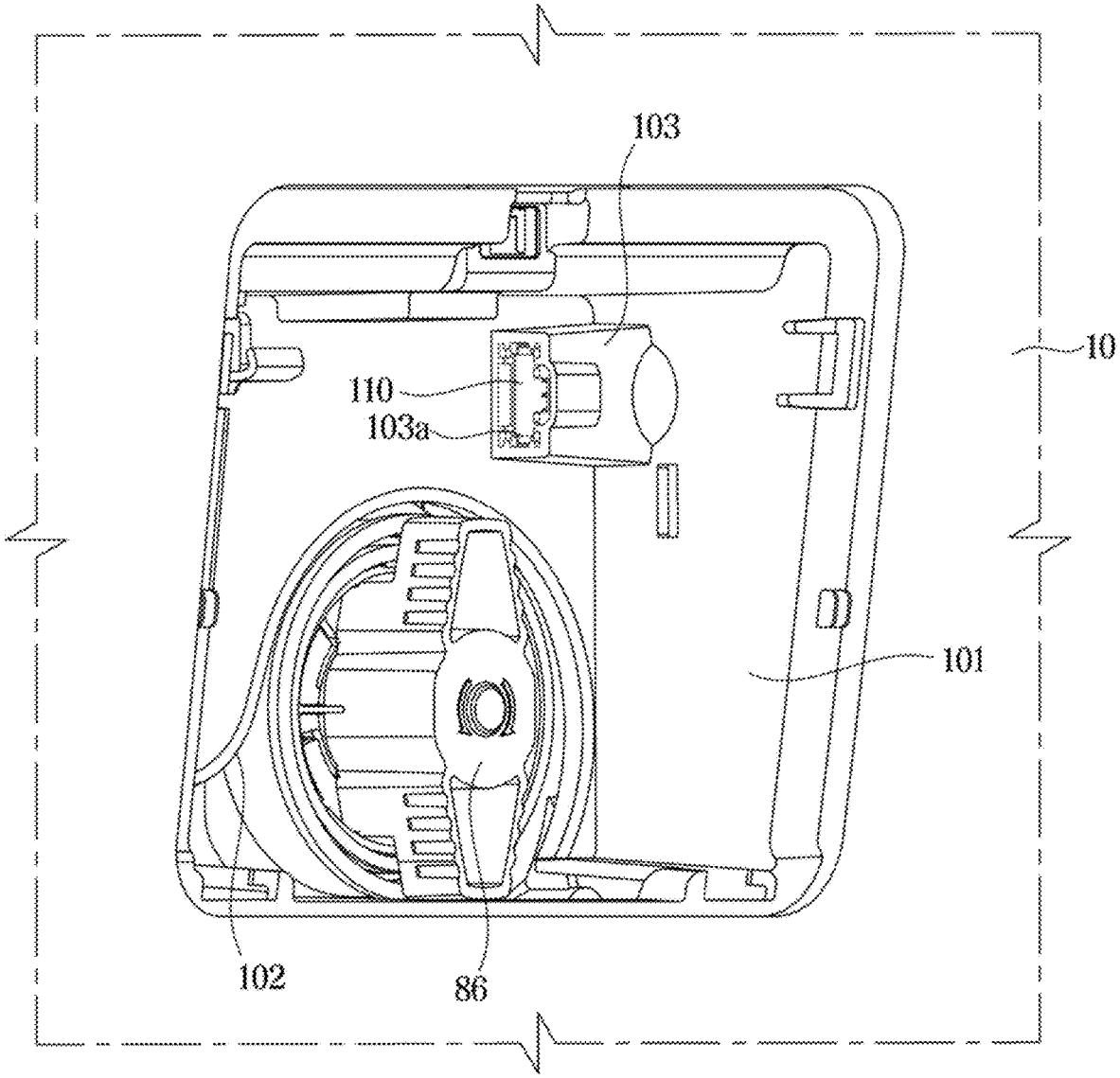
FIG. 6 is a view illustrating a service port located inside the pump housing shown in FIG. 5.
Figure 7:
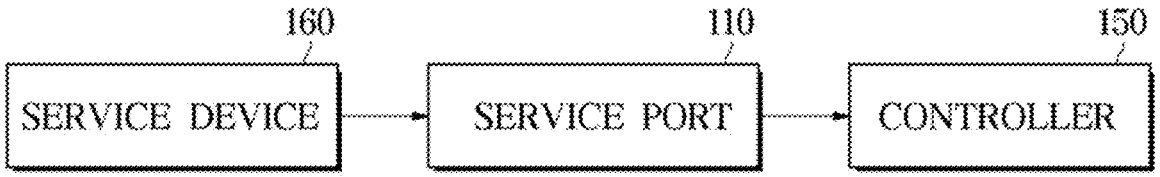
FIG. 7 is a block diagram illustrating a connection relationship between a service device, a service port, and a controller when the service device is connected to the service port shown in FIG. 5.
Figure 8:
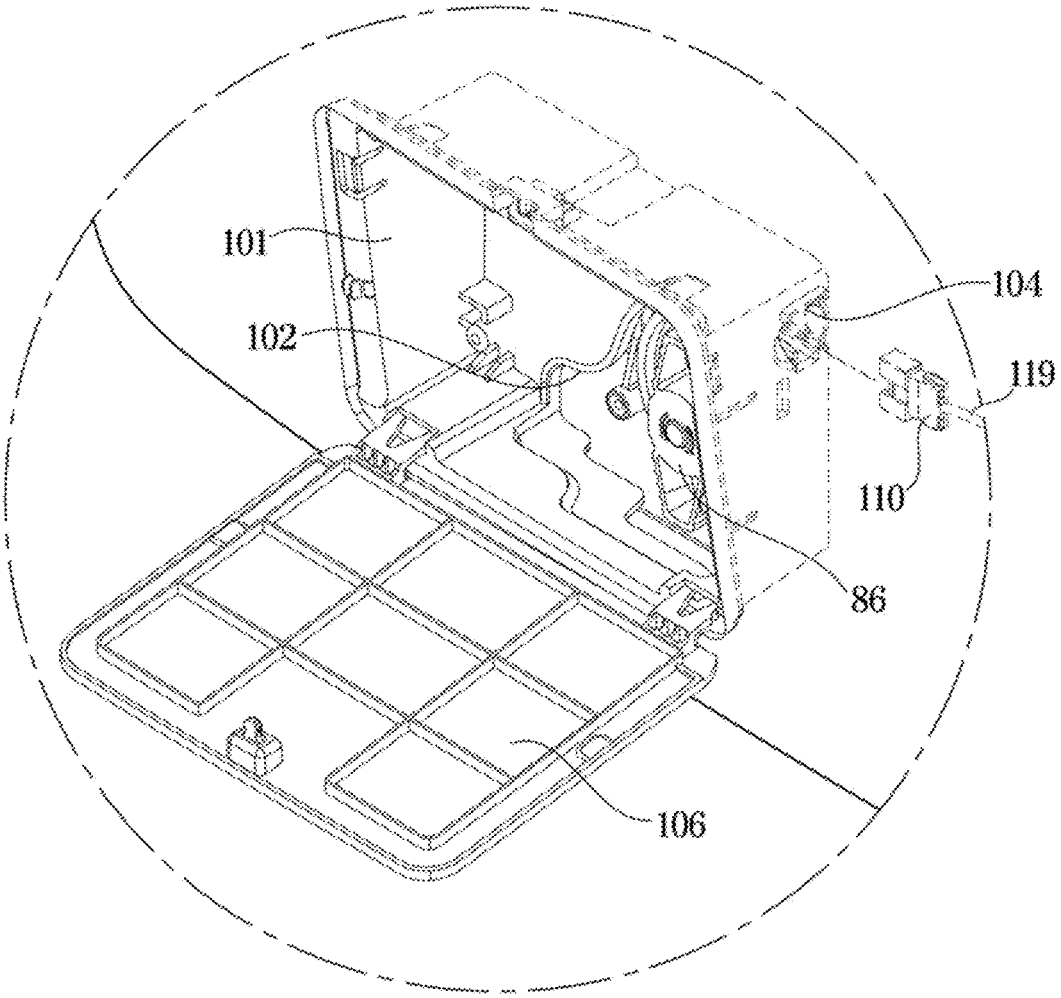
FIG. 8 is a view illustrating a state in which the service port shown in FIG. 4 is separated from the pump housing.
Figure 9:
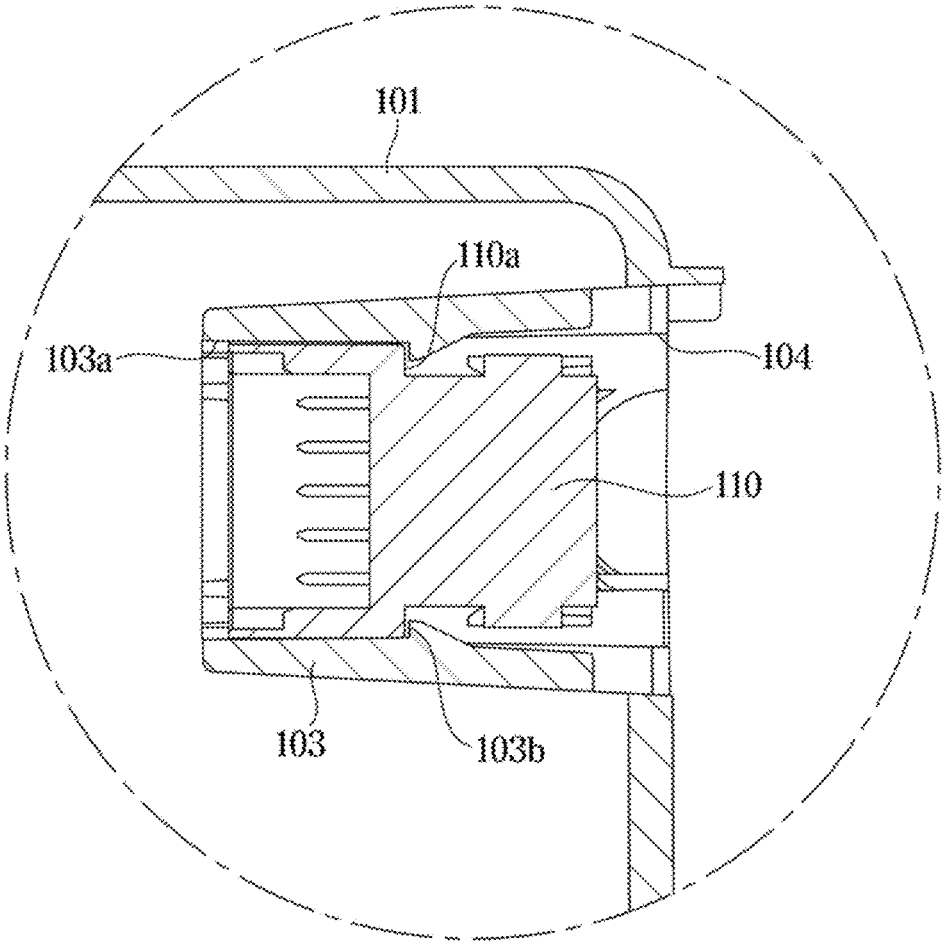
FIG. 9 is a view illustrating a part of a cross section taken along line B-B' of FIG. 4.

FIG. 4 is an enlarged view of a front surface of part A shown in FIG. 2. FIG. 5 is a front view illustrating a portion having a pump housing of the washing machine shown in FIG. 4. FIG. 6 is a view illustrating a service port located inside the pump housing shown in FIG. 5. FIG. 7 is a block diagram illustrating a connection relationship between a service device, a service port, and a controller when the service device is connected to the service port shown in FIG. 5. FIG. 8 is a view illustrating a state in which the service port shown in FIG. 4 is separated from the pump housing. FIG. 9 is a view illustrating a part of a cross section taken along line B-B' of FIG. 4.

Referring to FIGS. 4 to 6, the washing machine 1 may include a pump housing 101, a pump cover 106 provided to cover the pump housing 101, and a service port 110 mounted on the pump housing 101.

The pump housing 101 may be mounted on the cabinet 10. The pump housing 101 may cover the drain pump 80. The pump housing 101 may cover the drain pump 80 while including a housing opening 102 configured to expose a pump handle 86. The pump handle 86 exposed through the housing opening 102 is provided for an operator to maintain and/or repair the drain pump 80.

The pump cover 106 may be provided to cover a front side of the pump housing 101 that is open. The pump cover 106 may cover to prevent the pump handle 86 exposed through the housing opening 102 from being exposed to the outside. The pump cover 106 may be detachably coupled to the pump housing 101. The pump cover 106 may be detachably coupled to the cabinet 10. When the pump cover 106 covers the open front side of the pump housing 101, the pump cover 106 may form a part of the front surface of the cabinet 10. Referring to FIG. 2, the operator may move the pump cover 106 to an open position and may access the pump handle 86 of the drain pump 80.

The service port 110 may be mounted on the pump housing 101. The pump housing 101 may include a port mounting portion 103 provided to mount the service port 110 thereon. The port mounting portion 103 may be located on one surface of the pump housing 101 covered by the pump cover 106. The port mounting portion 103 may be located on an inner surface of a right side of the pump housing 101. The port mounting portion 103 may include a connection opening 103*a* formed so that the service port 110 is connected to a service device 160. A part of the service port 110 may be exposed through the connection opening 103*a*.

Referring to FIGS. 7 and 8, the service port 110 may be electrically connected to a controller 150 by a port wire 119. The part of the service port 110 exposed through the connection opening 103*a* may be electrically connected to the service device 160.

Referring to FIG. 8, the pump housing 101 may include a coupling portion 104 formed on an outer surface of a left side thereof to be coupled to the service port 110. The coupling portion 104 may be located at the other end of the port mounting portion 103 opposite to one end at which the connection opening 103*a* is located.

Referring to FIGS. 8 and 9, one end of the service port 110 connected to the service device 160 is disposed to face the connection opening 103*a*, and the other end of the service port 110 from which the port wire 119 extends is disposed to face the coupling portion 104. The service port 110 may be hook-coupled to the port mounting portion 103. The service port 110 may include a step portion 110*a*, and the port mounting portion 103 may include a port locking portion 103*b*. In a state in which the service port 110 is mounted on the port mounting portion 103, the port locking portion 103*b* supports the step portion 110*a* and prevents the service port 110 from being separated from the port mounting portion 103.

Referring to FIGS. 4 to 6, when the pump cover 106 is in an open state, the operator may electrically connect the service device 160 to the service port 110 located on the pump housing 101. The service device 160 connected to the service port 110 may be configured such that the controller 150 updates firmware of the washing machine 1 or checks and displays an error code of the washing machine 1.

As described above, the washing machine 1 according to the embodiment of the disclosure has the service port 110 located in the pump housing 101 that is disposed on the front surface of the cabinet 10 rather than on the rear surface, so that accessibility to the service port 110 may be improved.

In addition, since the service port 110 is accessible from the front side of the washing machine 1, the washing machine 1 does not need to be moved to access the service port 110, so maintenance and/or repair of the washing machine 1 is facilitated.

In addition, since the service port 110 is generally covered by the pump cover 106 without being exposed to the outside, the appearance of the washing machine 1 may not be damaged.

Figure 10:
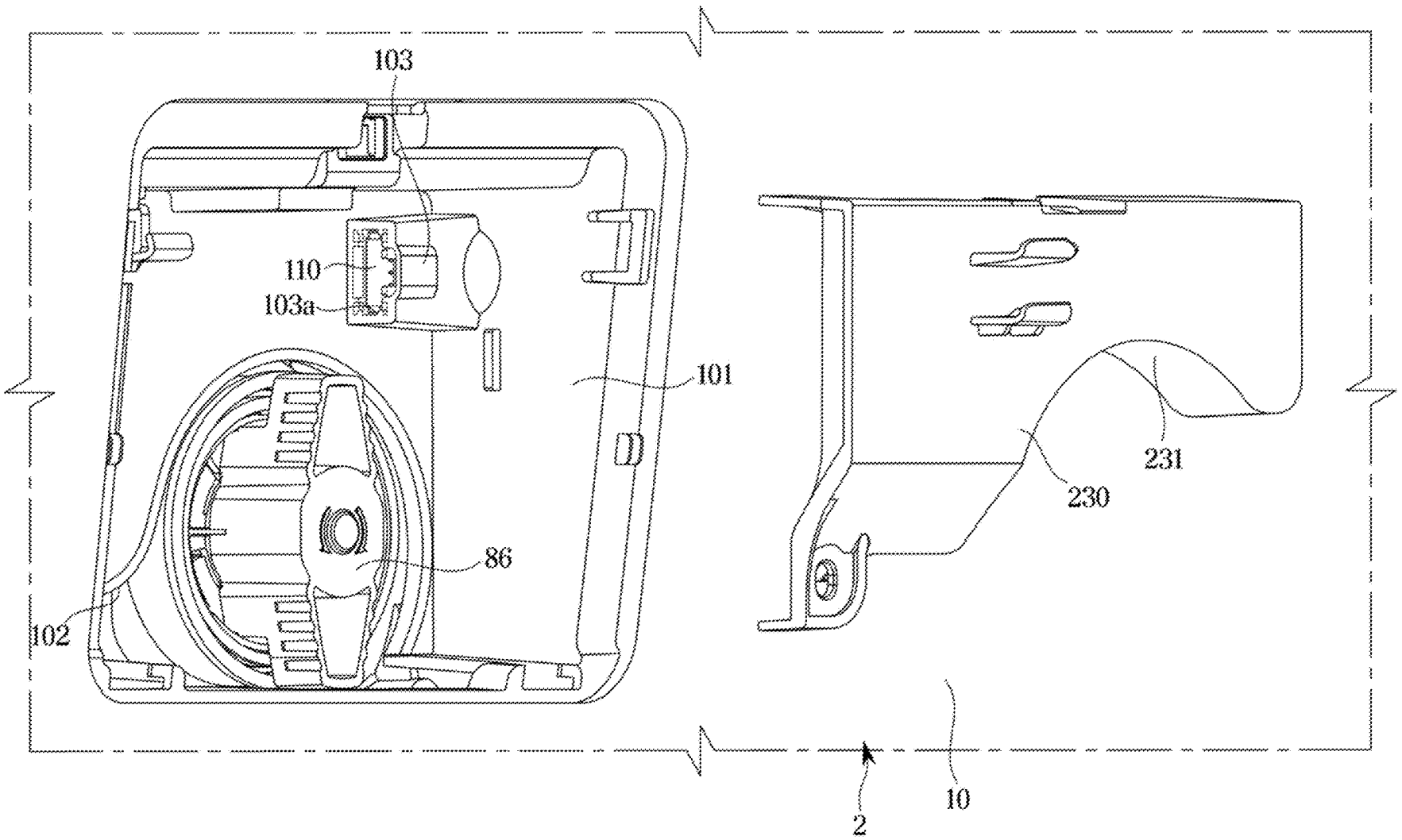
FIG. 10 is a view illustrating a pump housing of a washing machine according to another embodiment of the disclosure.

FIG. 10 is a view illustrating a pump housing of a washing machine according to another embodiment of the disclosure.

Referring to FIG. 10, a pump housing 101 of a washing machine 2 according to another embodiment of the disclosure will be described. The same reference numerals are assigned to the same components as those in the embodiment shown in FIGS. 4 to 6, and detailed descriptions of the same components may be omitted.

Referring to FIG. 10, the washing machine 2 according to the embodiment of the disclosure includes a port cover 230 that covers the service port 110. The port cover 230 may be formed to cover a part of the pump housing 101 in which the service port 110 is disposed.

The port cover 230 may include a cover opening 231 formed to correspond to a housing opening 102. As the cover opening 231 is formed to correspond to the housing opening 102, the pump handle 86 may be exposed to the outside when the pump cover 106 is open.

The port cover 230 may be detachably coupled to the pump housing 101. The port cover 230 may cover the service port 110 not to expose the service port 110 to the outside even when the pump cover 106 is open. The port cover 230 may be formed to prevent the service port 110 from being exposed to moisture. That is, the port cover 230 may be provided to prevent the service port 110 from being damaged by moisture. When the operator desires to update the firmware of the washing machine 2 or check the error code of the washing machine 2, the operator may open the drain cover 106, separate the port cover 230 from the pump housing 101, and then access the service port 110.

Figure 11:
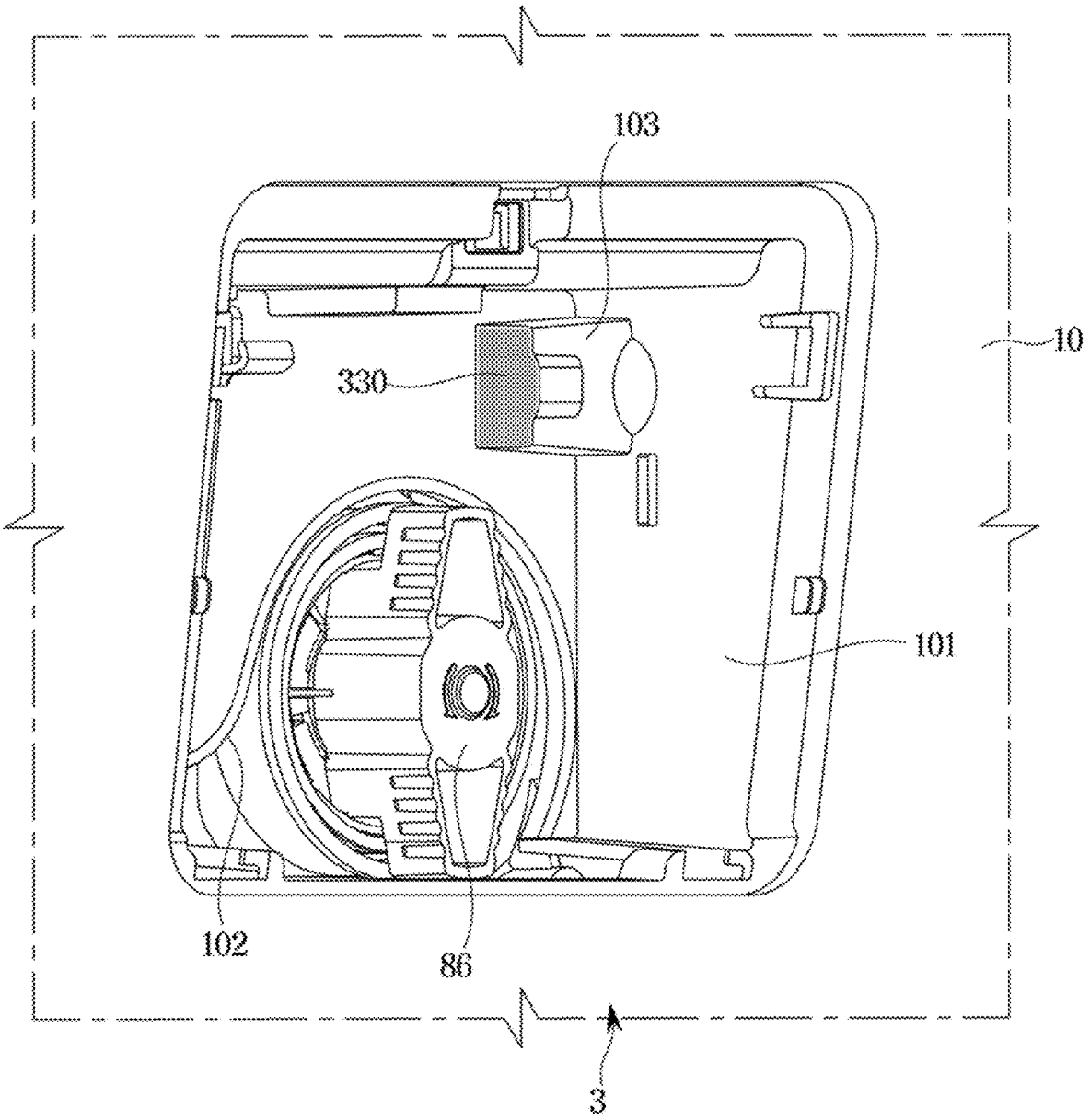
FIG. 11 is a view illustrating a pump housing of a washing machine according to an embodiment of the disclosure.

FIG. 11 is a view illustrating a pump housing of a washing machine according to an embodiment of the disclosure.

Referring to FIG. 11, a pump housing 101 of a washing machine 3 according to another embodiment of the disclosure will be described. The same reference numerals are assigned to the same components as those in the embodiment shown in FIGS. 4 to 6, and detailed descriptions of the same components may be omitted.

Referring to FIG. 11, the washing machine 3 according to the embodiment of the disclosure may include a port cover 330 that covers the service port 110. The port cover 330 may be provided to cover a connection opening 103*a* of the port mounting portion 103. The port cover 330 may include a material having elasticity. The port cover 330 may be fitted to the connection opening 103*a* by elasticity to cover the service port 110.

The port cover 330 may prevent moisture from penetrating into the service port 110. The port cover 330 may prevent the service port 110 from being exposed to moisture or foreign substances. When the operator desires to update the firmware of the washing machine 3 or check the error code of the washing machine 3, the operate may open the drain cover 106, separate the port cover 330 from the pump housing 101, and then access the service port 110.

Figure 12:
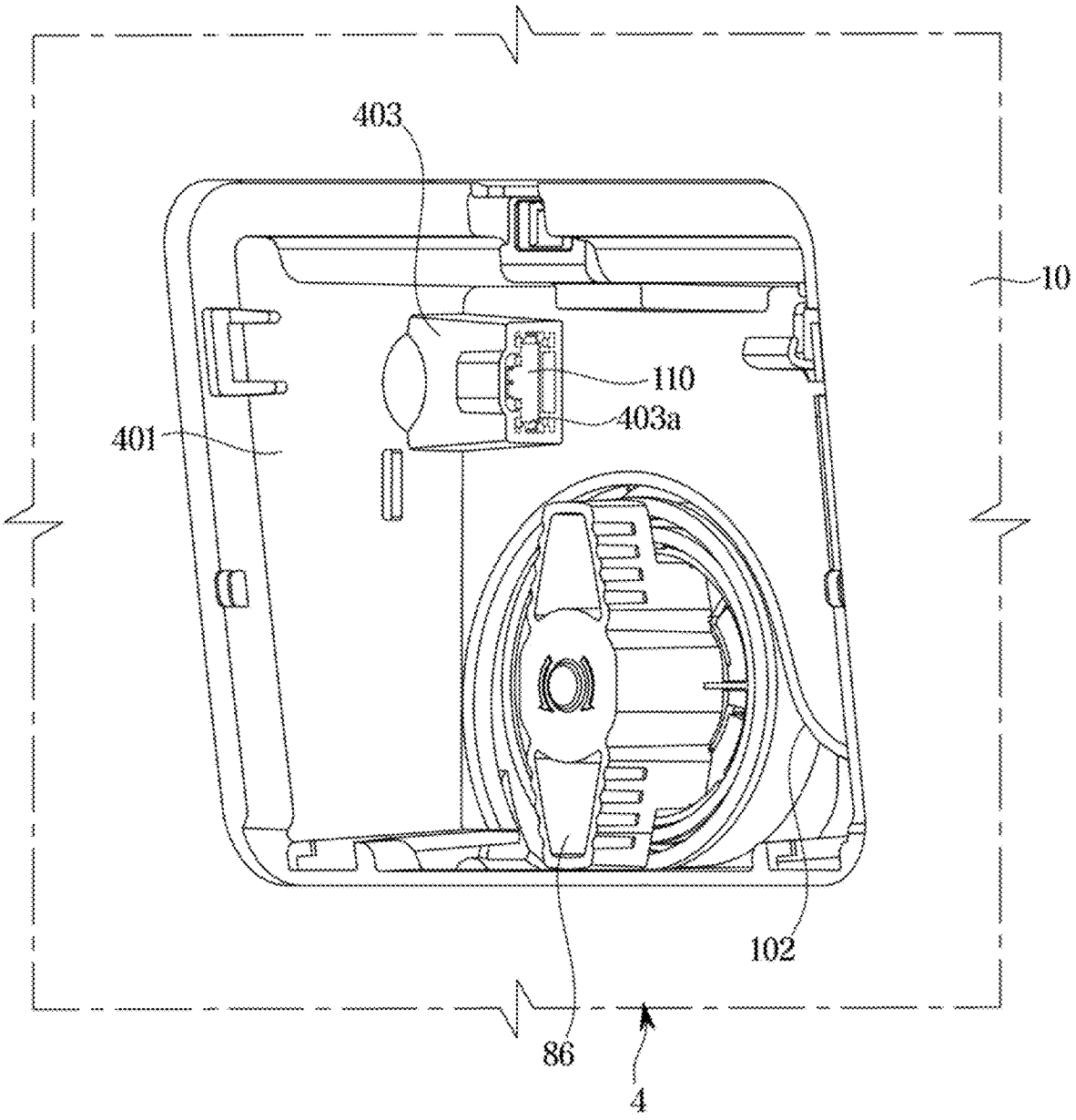
FIG. 12 is a view illustrating a pump housing according to an embodiment of the disclosure.

FIG. 12 is a view illustrating a pump housing according to an embodiment of the disclosure.

Referring to FIG. 12, a pump housing 401 of a washing machine 4 according to an embodiment of the disclosure will be described. The same reference numerals are assigned to the same components as those in the embodiment shown in FIGS. 4 to 6, and detailed descriptions of the same components may be omitted.

Referring to FIG. 12, the pump housing 401 of the washing machine 4 according to the embodiment of the disclosure may include a port mounting portion 403 disposed on a left side inner surface thereof. Accordingly, the service port 110 may be inserted into the port mounting portion 403 from a left side outer surface of the pump housing 401. The service port 110 may be exposed to the outside through the connection opening 403*a* of the port mounting portion 403 when the pump cover 106 is open.

Figure 13:
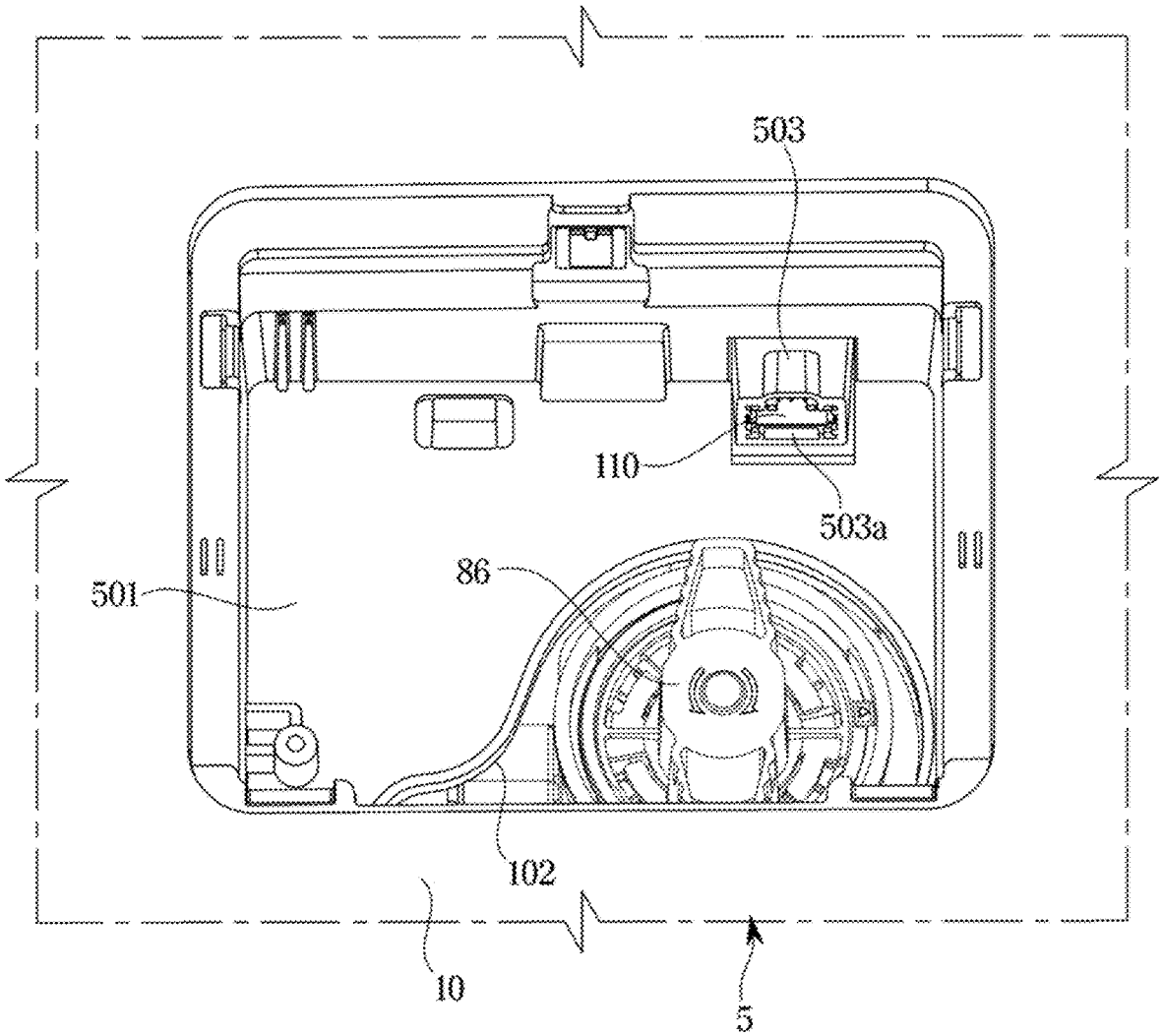
FIG. 13 is a view illustrating a pump housing according to an embodiment of the disclosure.

FIG. 13 is a view illustrating a pump housing according to an embodiment of the disclosure.

Referring to FIG. 13, a pump housing 501 of a washing machine 5 according to an embodiment of the disclosure will be described. The same reference numerals are assigned to the same components as those in the embodiment shown in FIGS. 4 to 6, and detailed descriptions of the same components may be omitted.

Referring to FIG. 13, the pump housing 501 of a washing machine 5 according to the embodiment of the disclosure may include a port mounting portion 503 disposed on an upper side inner surface thereof. Accordingly, the service port 110 may be inserted into the port mounting portion 503 from an upper side outer surface of the pump housing 501. The service port 110 may be exposed to the outside through a connection opening 503*a* of the port mounting portion 503 when the pump cover 106 is open.

Figure 14:
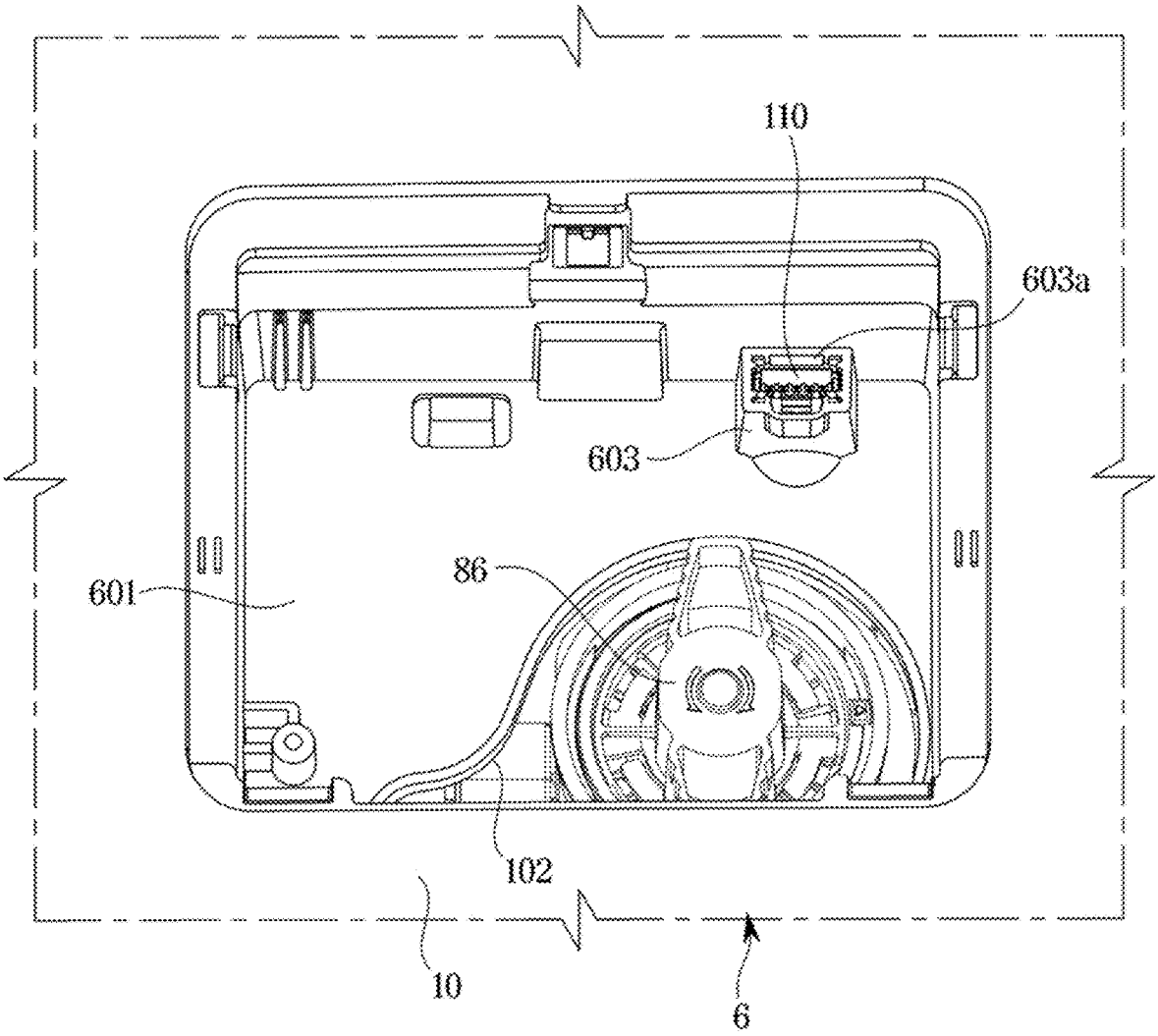
FIG. 14 is a view illustrating a pump housing according to an embodiment of the disclosure.

FIG. 14 is a view illustrating a pump housing according to an embodiment of the disclosure.

Referring to FIG. 14, a pump housing 601 of a washing machine 6 according to an embodiment of the disclosure will be described. The same reference numerals are assigned to the same components as those in the embodiment shown in FIGS. 4 to 6, and detailed descriptions of the same components may be omitted.

Referring to FIG. 14, the pump housing 501 of the washing machine 5 according to the embodiment of the disclosure may include a port mounting portion 603 disposed on a rear side inner surface thereof. Accordingly, the service port 110 may be inserted into the port mounting portion 603 from an rear side outer surface of the pump housing 601. The service port 110 may be exposed to the outside through a connection opening 603*a* of the port mounting portion 603 when the pump cover 106 is open.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A washing machine comprising:

a cabinet;

a tub disposed inside the cabinet;

a drain pump configured to discharge water from the tub, the drain pump including a pump handle;

a service port connectable to a service device, and configured to receive or transmit error information of the washing machine therethrough in response to connecting the service device to the service port;

a pump housing in which the service port is disposed, and mounted on a part of the cabinet in which the drain pump is located, the pump housing including:

a housing opening through which the pump handle is exposed therethrough and a port mounting portion on which the service port is mounted; and a pump cover detachably coupled to the pump housing to open or close the pump housing, wherein:

the port mounting portion includes a connection opening to allow a part of the service port to be exposed in the pump housing;

in response to opening the pump housing by the pump cover, the pump handle and the service port are exposed and accessible;

in response to closing the pump housing by the pump cover, the pump cover covers the pump housing thereby covering the pump handle and the service port; and the service port includes a step portion, the port mounting portion includes a port locking portion; and the port locking portion is configured to support the step portion to prevent the service port from being separated from the port mounting portion in response to mounting the service port on the port mounting portion.

2. The washing machine of claim 1, wherein in response to closing the pump housing by the pump cover, the service port is hidden inside the pump housing.

3. The washing machine of claim 2, wherein in response to closing the pump housing by the pump cover, the pump cover forms a part of a front surface of the cabinet.

4. The washing machine of claim 2, further comprising a port cover detachably coupled to the pump housing to cover a part of the pump housing where the service port is disposed within the pump housing, and the pump cover is detachably coupled to the pump housing to cover the port cover and the pump housing.

5. The washing machine of claim 4, wherein the port cover includes a cover opening having a shape corresponding to a shape of the housing opening so that the pump handle is exposed in the pump housing while the port cover covers the part of the pump housing where the service port is located.

6. The washing machine of claim 5, wherein the pump housing covers a part of the drain pump while the pump handle is exposed in the pump housing through the housing opening of the pump housing.

7. The washing machine of claim 1, further comprising a port cover to open or close the connection opening, and the port cover is made of an elastic material.

8. The washing machine of claim 1, wherein the port mounting portion protrudes from an inner surface of the pump housing that is covered by the pump cover.

9. The washing machine of claim 1, wherein the service port is hook-coupled to the port mounting portion.

10. The washing machine of claim 2, wherein the service port is accessible in response to opening the pump housing by the pump cover.

11. The washing machine of claim 1, wherein the pump housing includes a material different from a material forming the cabinet.

12. The washing machine of claim 2, wherein the pump cover is rotatably coupled to the pump housing to open or close the pump housing so that the service port is hidden inside the pump housing in response to closing the pump housing by the pump cover.

13. The washing machine of claim 1, further including a controller electrically connected to the service port, and wherein in response to connecting the service device to the service port, the controller is configured to update firmware of the washing machine or transmit error codes included in the error information to the service device.

* * * * *